US005413044A

United States Patent [19]

Wu et al.

[11] Patent Number: 5,413,044

[45] Date of Patent: May 9, 1995

[54] SACK NET FOR PRINTING PRESS ANTI-SMEAR TRANSFER CYLINDER

[76] Inventors: William B. Wu, 1651 Taraval St., San Francisco, Calif. 94116; Brian Yu, 5626 Chestnut Common, Fremont, Calif. 94538

[21] Appl. No.: 941,226

[22] Filed: Sep. 4, 1992

[51] Int. Cl.[6] ..... B41F 30/04

[52] U.S. Cl. ..... 101/420; 101/416.1; 101/417; 101/419; 101/422; 118/DIG. 15

[58] Field of Search ..... 132/274; 101/416.1, 101/417, 418, 419, 420, 423, 424, 424.2, 425, 422; 118/DIG. 15

[56] References Cited

U.S. PATENT DOCUMENTS

| | | | |
|---|---|---|---|
| 2,487,358 | 11/1949 | Morins | 132/274 |
| 2,740,412 | 4/1956 | Mayer | 132/274 |
| 4,407,267 | 9/1983 | DeMoore | 101/419 |
| 4,694,750 | 9/1987 | Greene | 101/426 |
| 4,762,315 | 8/1988 | Witter | 272/1 R |

*Primary Examiner*—Edgar S. Burr
*Assistant Examiner*—Lynn D. Hendrickson
*Attorney, Agent, or Firm*—Eli Lieberman

[57] ABSTRACT

A ready-made fabric sack with an elastic string around the periphery of the sack opening to be placed over a transfer cylinder in a printing press. When placed over the transfer cylinder, the inherent resiliency of the fabric and string causes the sack to envelop the cylinder to provide a resilient fabric surface which prevents smearing and streaking of wet printed sheets.

10 Claims, 2 Drawing Sheets

SACK NET FOR PRINTING PRESS ANTI-SMEAR TRANSFER CYLINDER

BACKGROUND OF THE INVENTION

This invention relates to a transfer cylinder used in a printing press to transfer a freshly printed sheet from one stage of the printing operation to another or to a final stacking location. The wet ink on printed sheets just off the impression cylinder is subject to smearing and streaking when moved by the transfer cylinder. This problem has received considerable attention in the design of printing presses and a number of approaches have evolved to deal with the problem.

U.S. Pat. No. 4,694,750 issued Sep. 22, 1987 to Joe E. Greene shows an antismear transfer cylinder made of a sheet of resilient material provided with a granular surface. In addition to the granular surface, the cylinder supports a pair of axially spaced elastic cords which extend slightly above the granular surface. Patentee states that the combination of a granular surface and spaced resilient cords affords improved antismear sheet transfer operation.

U.S. Pat. No. 4,402,267 issued Sep. 6, 1983 to Howard W. De Moore shows an antismear transfer cylinder provided with a smooth plastic coating. A sheet of loosely woven, lightweight cotton material such as guaze is wrapped around the cylinder to provide a fabric surface. The fabric sheet is attached to the cylinder by means of VELCRO strips placed on internal rim portions and at flange portions axially extending along the conventional slot opening in the transfer cylinder. The fabric sheet covering is sized to fit the cylinder so as to hug the surface yet be capable of some movement with respect to the surface.

While the above mentioned patents do teach structures which are effective in reducing transfer cylinder smearing and streaking, they do involve some additional manufacturing costs and complexities in installation and use. There is a need for a transfer cylinder of increased effectiveness, of reduced cost, and of increased simplicity in use and installation. The instant invention is directed to a device which meets the above criteria.

SUMMARY OF THE INVENTION

The overall object of the present invention is to improve upon the prior art transfer cylinders by providing an effective, easily installed, reduced cost, fabric net covering for a transfer cylinder.

It is a specific object of the invention to provide a ready-made, one piece fabric sack with an elastic string around the periphery of the opening of the sack to receive the transfer cylinder. When the transfer cylinder is fed into the sack the inherent resiliency of the fabric combined with the resiliency of the elastic string causes the sack to envelop and hug the exposed surface of the cylinder thereby producing an effective surface to handle wet printed sheets.

It is another object of the invention to reduce the manufacturing costs of a transfer cylinder by eliminating the need for VELCRO strips or other holding devices to secure the fabric net to the cylinder.

It is another object of the invention to eliminate the need to measure and cut a sheet of net material to fit the transfer cylinder, thereby simplifying the installation.

It is yet another object of the invention to provide the transfer cylinder with a fabric net which does not loosen in use and separate from the cylinder.

DESCRIPTION OF THE PREFERRED EMBODIMENT

Figure 1:
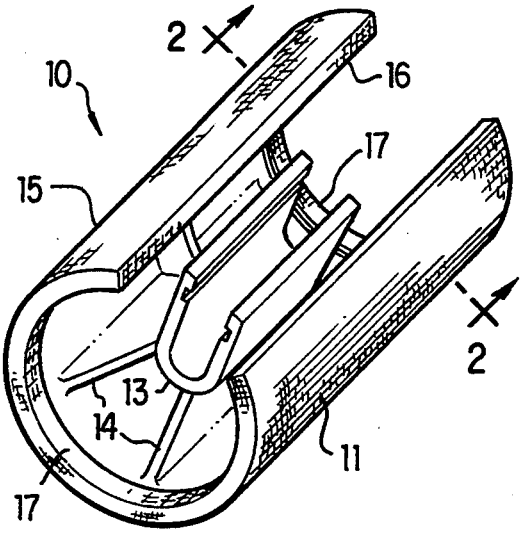
FIG. 1 PRIOR ART
FIG. 1 is a perspective view of a prior art transfer cylinder with a fabric net mounted on the surface.
Figure 2:
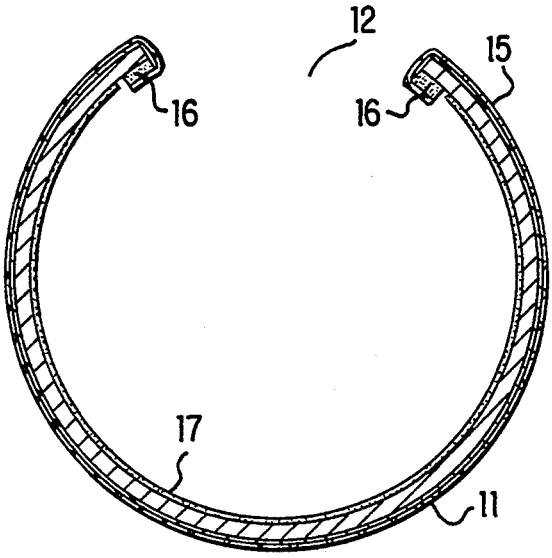
FIG. 2 PRIOR ART
FIG. 2 is a cross sectional view taken along lines 2—2 of FIG. 1.
Figure 3:
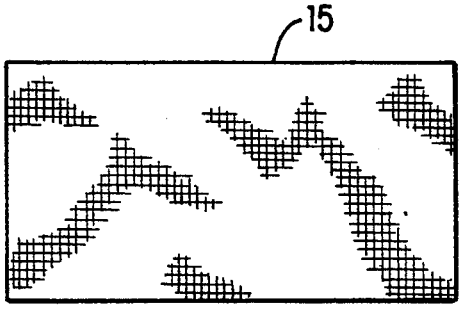
FIG. 3 PRIOR ART
FIG. 3 is a prior art fabric net before cutting and mounting on the FIG. 1 transfer cylinder.

Referring now in general to the drawings and in particular to FIGS. 1–3, a prior art transfer cylinder 10 is Shown comprising a metallic part cylindrical surface 11 with a longitudinal slot 12 extending the length thereof to accommodate paper gripping means, not shown. A U-shaped mounting hub 13 supported by flat spokes 14 is adapted to be locked to a driving shaft, not shown, to rotate the transfer cylinder in timed realtionship with other components of the printing press.

The surface of the cylinder is covered with a net 15 which is made of a loosely woven cotton fabric that possesses some inherent resiliency. The net 15 is secured to the cylinder by means of a pair of slot Velcro strips 16 mounted on internal surfaces of the cylinder adjacent edges defining slot 12. The Velcro strips 16 are shown in FIG. 2 and their location is shown in FIG. 1. Another pair of rim Velcro strips 17 are mounted internally of the cylinder at circumferential rim portions.

To equip the transfer cylinder with a surface net, a suitable fabric sheet as shown in FIG. 3 is cut to a size to fit the cylinder surface with overlapping portions at the edges and rims. The sheet is then centrally attached to a slot Velcro strip 16 at one edge and wrapped around the cylinder and secured to the Velcro strip at the other edge. The portions of the sheet overhanging the rims are then tucked against the rim Velcro strips 17. Any excess material can be trimmed away with a scissors. The sheet so mounted on the cylinder forms a resilient net capable of a certain amount of slip with respect to the cylinder surface as it engages a wet printed sheet. This slight resilient motion greatly reduces ink smearing.

Figure 4:
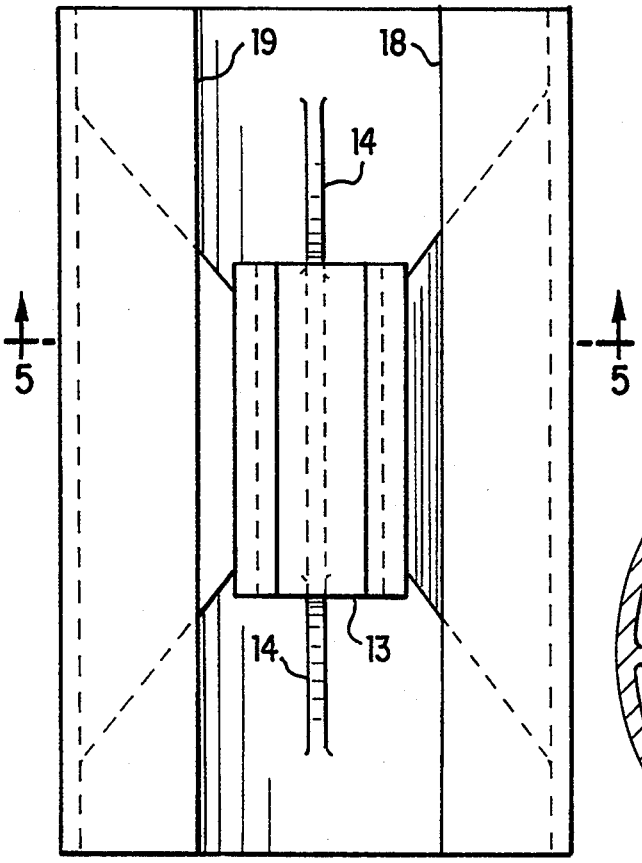
FIG. 4 is a view looking down into a transfer cylinder without a fabric covering.
Figure 5:
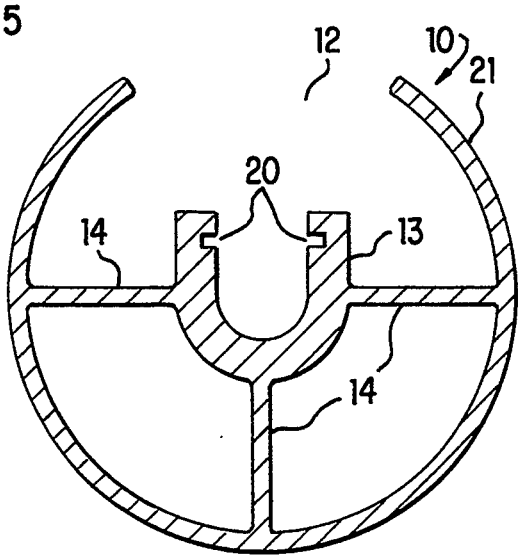
FIG. 5 is a cross sectional view taken along lines 5—5 of FIG. 4.

Referring now to FIGS. 4 and 5 which show a transfer cylinder similar to the cylinder shown in FIGS. 1 and 2 with the exception of the omission of the Velcro strips 16 and 17 and attached fabric net 15. The same numerals will be used in FIGS. 4 and 5 to identify common components.

The cylinder 10 has a slot opening 12 defined by edges 18 and 19. A hub 13 is medially mounted on the central axis of the cylinder and is supported by three flat spokes 14. The hub 13 is provided with grooves 20 to receive a locking mechanism, not shown, to lock the hub to a driving shaft which is part of the printing press.

The outer surface of the cylinder may be coated with a thin slick coating 21 to provide a slippery surface for the fabric net to be described below. The coating may be applied in a number of ways. The cylinder may be sprayed with or dipped in a suitable plastic formulation. It may be covered with a thin sheet of suitable material adhesively bonded thereto. The coating is also arranged to cover the slot edges 18 and 19.

Figure 6:
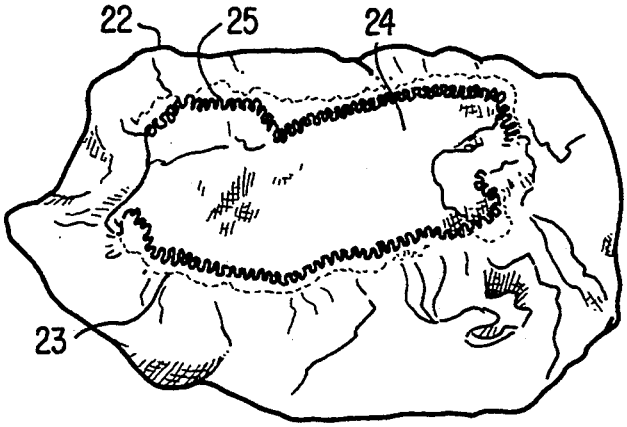
FIG. 6 is a view of the fabric sack of the invention.
Figure 7:
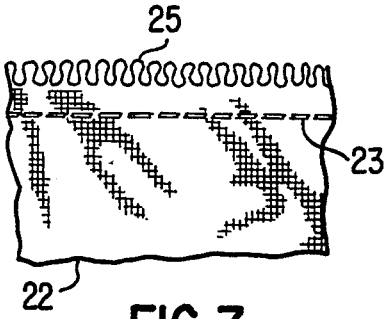
FIG. 7 is a view of a section of the hem and elastic string of the invention.

The fabric net 22 of the invention is shown in FIGS. 6 and 7 and comprises a ready-made sack with an elastic string 23 around the periphery of the sack opening 24. It resembles a shower cap with the exception that the material used is an open weave resilient cloth instead of a waterproof plastic. The sack net is formed of a piece of material whose overall dimensions and shape are predetermined by a fitting operation to cover a particular transfer cylinder. The edge of the material is provided with a hem 25 to prevent any loose strands from unraveling and possibly interfering with the operation. After the hem is sewn in place, the material is bunched together to define the opening 24 of the fabric sack net 22 and the elastic string 23 is sewn in place as shown in FIG. 7. It should be clear that the hem stitching, the stitching securing the elastic string as well as the elastic string itself is subject to various modifications which are well within this disclosure. For example, the elastic string may comprise a flat elastic band and the hem and elastic string may be sewn together in one operation.

Figure 8:
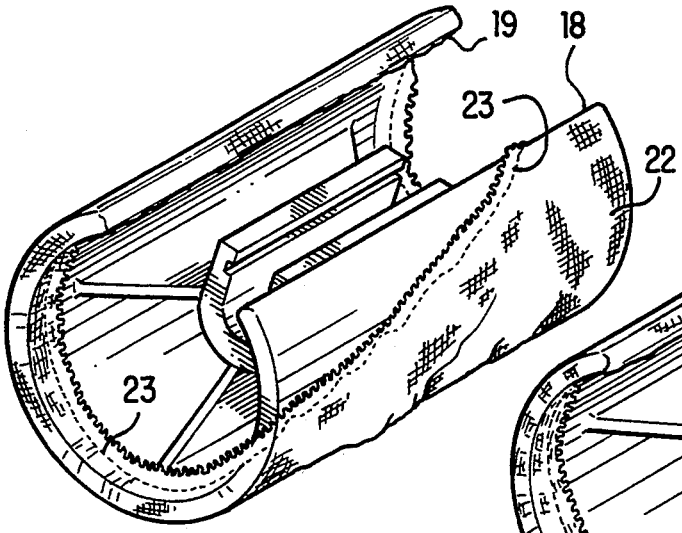
FIG. 8 is a view showing the transfer cylinder of FIG. 4 being inserted in the fabric sack of the invention.
Figure 9:
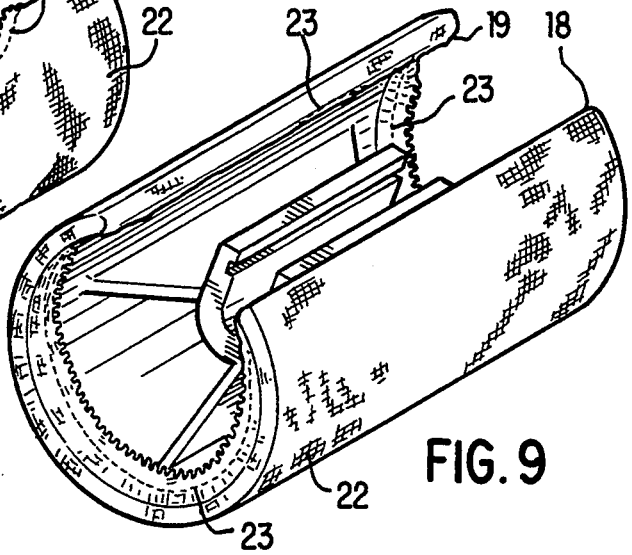
FIG. 9 is a perspective view showing the fabric sack of the invention installed on the transfer cylinder.
Figure 10:
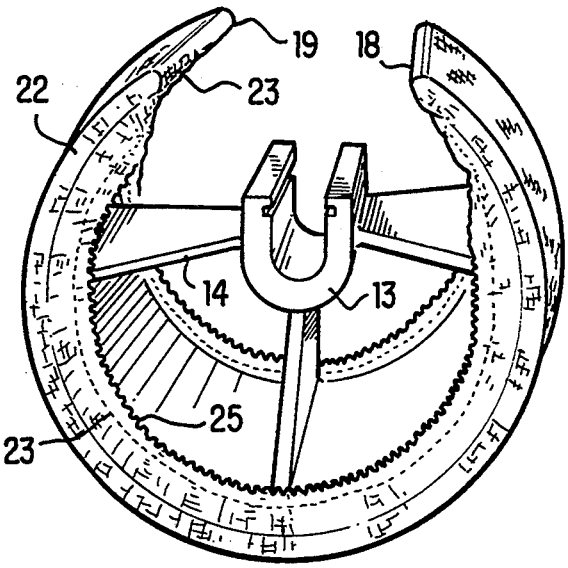
FIG. 10 is a perspective view showing the action of the elastic cord in shaping the sack around the edges of the transfer cylinder.

Referring now to FIGS. 8–10, the manner of installing the fabric sack net of this invention on the transfer cylinder will now be explained. The transfer cylinder is placed in the fabric sack through the expanded opening 24 to engage one of the slot edges 18 or 19 as shown in FIG. 8 and then fed over the other edge as shown in FIG. 9. Because of the lack of any Velcro strips or other fastening devices, the sack net assumes a natural position over the transfer cylinder due to the predetermined elastic cord and fabric resiliency. At most, a slight adjustment may be necessary to center the edge portion covering the rim as shown in FIG. 10.

It should also be noted that the elastic cord prevents the fabric net from flying off the cylinder as it rotates. It also maintains a predetermined set tension of the fabric against the cylinder surface which is self compensating.

In most instances the sack net will be installed or removed while the transfer cylinder is in the printing press. With the power off, the sack net is placed over the leading edge of the cylinder and the cylinder is rotated by hand until the trailing edge is within reach to mount the sack net over it. A slight smoothing and adjusting operation by hand may be necessary to complete the installation. The sack net is removed by simply lifting it off the leading and trailing edges of the cylinder.

In addition to greatly simplifying the construction and installation of a fabric net, an added advantage is the capability of the sack net to move with respect to the cylinder at the edge and rim portions. The prior art transfer cylinders using Velcro or adhesives do not permit rim and edge movement. However, it must be emphasized that the sack net of this invention is also usable with transfer cylinders equipped with Velcro retaining strips.

While the fabric sack of the invention has been primarily disclosed for use on a transfer cylinder, it should be clearly understood that the fabric sack concept may also be applied to transfer wheels which are the equivalent of transfer cylinders of reduced length.

It is not intended to limit the present invention to the details of illustration or terms of description of the embodiments shown above. It will be appreciated by those skilled in the art that various modifications and alterations therein may be made within the scope of the present invention.

What is claimed is:

1. An antismear covering in combination with a transfer cylinder in a printing press, said cylinder having a longitudinal slot in the surface thereof defined by two arcuately spaced edges, said cylinder having a rim portion at each end thereof, said covering comprising a sack formed of an open weave fabric material, said sack having an opening, an elastic string attached to and surrounding said opening, said sack receiving said cylinder through said opening with said elastic string embracing said slot edges at internal cylindrical portions and extending around said rim portions internally spaced therefrom whereby said sack covers said cylinder external surface providing a smooth resilient fabric covering.

2. The combination of claim 1 wherein said fabric sack is designed with a predetermined shape and predetermined elasticity in cooperation with a predetermined elastic string elasticity to cover the surface of the cylinder with the requisite tension.

3. The combination of claim 2 wherein said fabric sack covering said surface of said cylinder is capable of limited sliding movement with respect to said surface.

4. The combination of claim 3 wherein said transfer cylinder surface is coated with a thin coating of plastic material having a low coefficient of sliding friction.

5. The combination of claim 4 wherein said transfer cylinder coating includes said slot edges and said rim portions.

6. The combination of claim 3 wherein said limited sliding movement includes sliding movement at said slot edges and said rim portions.

7. The combination of claim 1 including a hem provided at said fabric sack opening to prevent fabric unravelling.

8. The combination of claim 1 wherein said elastic string is stitched to said fabric sack around said opening.

9. A method of making an antismear transfer cylinder for a printing press, said method comprising the step of forming a circular cylinder with spaced rims and an arcuate slot defined by two parallel edge portions, the step of providing a resilient fabric sack having an opening to receive the cylinder and sized to fit the surface of the cylinder, providing the sack with an elastic string affixed to the periphery of the opening of the sack and placing the sack over the cylinder with the elastic string coming to rest coextensively with the edge portions and spaced rims of the cylinder.

10. The method of claim 9 including the step of fabricating the sack of a fabric of a predetermined initial shape and resiliency to yield the proper cylinder surface tension when placed over the cylinder.

* * * * *